US005230285A

United States Patent [19]

Cogswell et al.

[11] Patent Number: 5,230,285

[45] Date of Patent: Jul. 27, 1993

[54] PRINTING PRESS COATING APPARATUS HAVING AN OSCILLATING ROLLER ASSEMBLY

[75] Inventors: John A. Cogswell, Westerly, R.I.; Frank A. Andaloro, Pawcatuck, Conn.

[73] Assignee: Herbert Products, Inc., Westbury, N.Y.

[21] Appl. No.: 641,435

[22] Filed: Jan. 15, 1991

[51] Int. Cl.[5] ..... B41F 31/06; B41F 31/14

[52] U.S. Cl. ..... 101/363; 101/DIG. 38

[58] Field of Search ..... 101/348, 349, DIG. 38, 101/216, 350, 148, 207-210, 363, 351, 352; 118/244, 256, 258, 259

[56] References Cited

U.S. PATENT DOCUMENTS 3,179,047 4/1965 Ordway .
3,283,741 11/1966 Brodie .
4,337,699 7/1982 Beisel .
4,753,167 6/1988 Shriver .
4,766,840 8/1988 Beckley et al. .
4,777,877 10/1988 Lemaster .
4,829,645 5/1989 Kannwischer .
4,869,167 9/1989 Villarreal .
5,003,874 4/1991 Junghans ..... 101/DIG. 38

*Primary Examiner*—J. Reed Fisher
*Attorney, Agent, or Firm*—Hoffmann & Baron

[57] ABSTRACT

The present invention is directed to a coating apparatus for a printing press. The apparatus includes an oscillating-metering roller having an internally disposed oscillation mechanism for delivering to a printed web a uniform fluid coating free from coater-imposed aberrations. The oscillation mechanism includes a translating means for translating a rotational movement into an oscillating movement, a velocity-modifying means for modifying the velocity of the rotational movement and a velocity-regulating means for providing a regulated, consistent velocity.

25 Claims, 8 Drawing Sheets

PRINTING PRESS COATING APPARATUS HAVING AN OSCILLATING ROLLER ASSEMBLY

FIELD OF THE INVENTION

The present invention relates to the printing industry and in particular to rollers which simultaneously oscillate during rotational movement in order to properly deliver and distribute ink or other liquid coatings to the surface of a web or other material. More particularly, the present invention relates to an oscillating-metering roller employed in either a coating device or similar liquid applicator assembly for applying coatings to webs in a printing press unit.

BACKGROUND OF THE INVENTION

There are many situations in industrial processes in which it is required that a thin film of a particular liquid substance be coated onto a receiving surface. For example, in a typical printing press, a series of rollers is employed to transfer specified amounts of printing ink or other liquid coatings to the surface of a printed web or an adjacent roller. It has been found that the distribution of ink and other fluid coatings is facilitated by providing for the simultaneous oscillation or vibration of these rollers along their rotational axes during roller rotation.

Some oscillating roller assemblies undergo the requisite oscillation by way of an oscillation means that is maintained externally from the roller to which the oscillating motion is imparted. Other oscillating roller assemblies employ an oscillation means that is maintained within the roller itself. The latter configuration typically employs some means by which a portion of the rotational force initially delivered to the roller is subsequently translated into an oscillating force by a mechanism internally disposed within the roller.

With respect to oscillating roller assemblies having an internally disposed oscillation means, it has been determined that the distribution of printing fluids or coatings by such rollers can be further enhanced where the velocity of oscillation is not solely a function of the rotational velocity of the roller, but is rather a function of the rotational velocity of the roller in conjunction with a means for accurately and independently reducing and maintaining a constant velocity for that portion of the rotational force which is subsequently translated into an oscillating movement.

In the past, various mechanisms have been developed in the printing industry to achieve the simultaneous oscillation of a roller during rotation. For example, U.S. Pat. No. 4,777,877 discloses an apparatus and method providing for the oscillation of ink form rollers in a printing press wherein the oscillating motion is imparted to the rollers by an outboard gear system that is maintained externally to the rollers. Similarly, U.S. Pat. No. 4,753,167 discloses a vibrator roller assembly wherein the vibrational or oscillating movement is imparted to the roller by way of a shaft driven by an externally maintained drive mechanism.

Although externally positioned oscillation mechanisms effectively impart an oscillating movement to a roller at a velocity which can be manipulated independently from the rotational velocity of the roller, a major shortcoming presented by such outboard oscillation mechanisms is that additional space is needed in order to accommodate the mechanism within or around the frame which supports the rollers. These spatial considerations become especially problematic when modifying an existing printing press assembly to receive an oscillating roller or when performing an in-line integration of an existing printing press unit with a coating mechanism containing rollers having an oscillation capability.

In response to the foregoing problem, oscillating rollers having inboard or internally contained means for oscillation were developed. For example, U.S. Pat. No. 4,337,699 discloses an oscillating roller 1 having an oscillation means contained within the roller jacket 2. The oscillating movement is achieved by two bushings and a ball bearing disposed within the roller jacket. A first bushing 15 revolves as a cage about a central shaft 4 and contains an elliptical groove 19 while the second bushing 13 is fixed within the roller jacket 2 and contains a circular groove 20. A ball bearing 21 travels in a keyway or channel created between grooves 19 and 20, thereby translating a portion of the rotational force imparted to the roller 1 into an oscillating force. The velocity of the oscillation is essentially a function of the rotational speed of the roller, although some reduction in speed does occur via friction between the ball bearing 21 and the channel created by grooves 19 and 20. No definitive means for accurately modifying or reducing the velocity of oscillation is provided.

Similarly, U.S. Pat. No. 4,869,167 discloses a variable-speed oscillating roller having an oscillation means contained within the roller. The oscillation means translates a portion of the rotational force imparted to the roller into an oscillating movement by way of a key 22 traveling in a groove or screw slot 24 present on the outer surface of a sleeve 18. The sleeve 18 is concentrically mounted about a shaft 14 which initially imparts the rotational force to the roller. An adjustment means 38 is provided to control the amount of frictional engagement which occurs between the sleeve 18 and the roller 12. By adjusting the degree of frictional engagement between the sleeve 18 and the roller 12, the rotational velocity of the sleeve 18 can be reduced relative to the rotational velocity of the roller 12. Consequently, the velocity of the oscillation is a function of both the rotational speed of the roller 12 and the degree of frictional engagement between the roller 12 and the sleeve 18.

A major shortcoming in both of the oscillating rollers previously described is that either the oscillation velocity is essentially only a direct function of the rotational velocity of the roller or it is partially dependent upon frictional mechanisms which are very difficult to establish and maintain. For example, some surface areas may undergo wear more readily than others, thereby resulting in a non-uniform oscillation velocity due to irregularities in the amount of friction present over the period of oscillation. Variations in oscillation velocity impair the uniform distribution of any liquid substance in which the roller is involved in transferring. In a coating apparatus employed in a printing press, a non-uniform distribution of the coating liquid applied to a web or an adjacent roller results in undesirable, coater-imposed patterns such as orange peel, striation and volcanoing.

An additional shortcoming of oscillating rollers having similar groove configurations to those rollers previously mentioned is that the oscillating motion becomes irregular at the edges of the oscillation cycle as the roller terminates its axial movement in one direction and proceeds to oscillate back in the opposite direction.

This phenomenon also contributes to the undesirable coater-imposed aberrations previously mentioned.

Consequently, it is an object of the present invention to provide an improved coating system having an oscillating roller for use in a printing press to deliver a controlled, evenly distributed coating or layer of a fluid substance to a printed web or other material without undesirable, roller-imposed coating aberrations such as orange peel, volcanoing and striations.

It is another object of the present invention to provide a new oscillating roller assembly for a coating mechanism whereby the coating mechanism delivers a controlled, evenly distributed fluid coating to a printed web or other material without undesirable roller-imposed coating aberrations such as orange peel, volcanoing in striations.

It is yet another object of the present invention to provide a new oscillating roller assembly which delivers a controlled, evenly distributed coating or layer of a fluid substance to the surface of a printed web or adjacent roller.

It is also a further object of the present invention to provide a new oscillating-metering roller assembly for a coating mechanism whereby the oscillating-metering roller performs a metering function in addition to delivering a controlled, evenly distributed coating or layer of a fluid substance to the surface of a printed web or adjacent roller without undesirable, roller-imposed coating aberrations such as orange peel, volcanoing and striations.

It is finally an object of the present invention to provide a new oscillating roller assembly for a coating mechanism having an internally disposed oscillation means which imparts a smooth and uniform oscillating motion to the roller at a constant velocity, the oscillation velocity being a function of the rotational velocity of the roller in conjunction with a means for accurately and independently modifying and maintaining the velocity of the portion of the rotational force that is to be subsequently translated into an oscillating force.

SUMMARY OF THE INVENTION

In accordance with the present invention, an improved liquid coating apparatus for a printing press is provided herein. The apparatus includes a drive means for driving the rollers of the coating apparatus in conjunction with an applicator means for transferring the coating fluid from the apparatus rollers to a printing press unit. A special oscillating roller is also provided for delivering a uniform, evenly distributed coating layer free from coater-imposed aberrations such as orange peel, striations and volcanoing. The oscillating roller contains an internally disposed oscillation means having a translating means for translating a portion of a rotational force initially delivered to the roller at a given velocity into an oscillating force, a velocity-modifying means for accurately modifying the velocity of that portion of the rotational force which is to be subsequently translated into an oscillating force and a velocity-regulating means positioned between the velocity-modifying means and the translating means for regulating the velocity of the rotational force delivered by the velocity-modifying means to the translating means.

In particular, the translating means is preferably any combination known in the art to effectively translate a rotational motion into an oscillating motion, most preferably the combination of a cam and a cam follower. The velocity-modifying means is a system of cooperating gears coupled to the roller to receive a rotational motion and operatively coupled to the translating means so as to impart a rotational motion thereto. The velocity-regulating means is a coupling operatively coupled between the velocity-modifying means and the translating means so as to deliver a rotational motion therebetween. The coupling is preferably of the Oldham-style known to those skilled in the art.

The preferred embodiment of the coating apparatus of the present invention includes a pan roller, an applicator roller and the oscillating roller previously discussed. The pan roller is positioned within the apparatus to transfer a coating fluid from a fluid reservoir to the oscillating roller. The oscillating roller, in turn, delivers the coating fluid to an applicator roller which, in turn, engages a blanket cylinder on the press unit, delivering the coating fluid to the cylinder for subsequent deposition on a web. The oscillating roller performs a metering function by virtue of its positioning between the pan roller and the applicator roller, smoothly oscillating back and forth axially at a constant velocity to deliver a uniform layer of coating fluid to the applicator roller.

Although the preferred embodiment of the present coating apparatus provides for the oscillating roller to be positioned between the pan roller and the applicator roller, other configurations are suitable as well, providing that the uniformity of the coating fluid layer imparted by the oscillating roller is not diluted by an access of roller transfers before being delivered to the web.

The oscillating roller includes a roller casing or jacket which is affixed to and concentrically mounted about a central shaft via two slide hubs such that rotation of the shaft imparts rotation to the casing. The shaft is rotatably mounted through two bearing supports and is supported by way of bearing assemblies positioned within the bearing supports. Disposed internally within the roller casing at one end of the roller is a ring gear having gear teeth formed on its internal diameter. The ring gear is statically mounted to an internal support affixed to the internal surface of the roller casing. Positioned concentrically about the central shaft at the same end of the roller is one of the bearing supports through which the shaft is rotatably received. Mounted eccentrically about the bearing support is a pinion gear which is rotatable about the support and has a series of gear teeth on its external diameter which communicate with the gear teeth on the internal diameter of the ring gear.

A constant velocity coupler is mounted about the central shaft adjacent to the pinion gear, communicating at one side with the pinion gear and at the opposite side with a barrel cam, also mounted about the shaft. The barrel cam is rotatable about the central shaft by way of a set of bearings interposed between the shaft and the cam. A helical groove traversing the outer surface of the barrel cam provides a channel in which a cam follower resides. The cam follower is also statically mounted to an internal support affixed to the roller casing such that any movement of the cam follower is imparted to the roller casing by necessity.

Upon rotation of the shaft, a rotational movement is imparted to the roller casing by way of the first of two slide hubs. As the roller casing rotates, the ring gear is forced into rotation due to its static relationship with the internal support which is, in turn, affixed to the roller casing. As the ring gear rotates, the gear teeth on its internal diameter are forced into communication with the gear teeth on the external diameter of the pinion gear, thereby causing the pinion gear to rotate eccentrically about the bearing support. The rotational force imparted to the pinion gear is ultimately translated into an oscillating movement by the barrel cam in conjunction with the cam follower and thereafter imparted to the roller casing.

The velocity of the rotational movement imparted to the ring gear is essentially the same as the roller casing, but the rotational velocity of the pinion gear is a function of both the rotational velocity of the roller casing as well as the gear ratio of the ring gear to the pinion gear. Consequently, the velocity of the rotation imparted to the ring gear by the roller casing can be subsequently modified by manipulating the gear ratio of the ring gear to the pinion gear, the velocity modification occurring prior to the transferral of any rotational movement to the pinion gear. As a result, the portion of the rotational force which is to be ultimately translated into an oscillating movement undergoes a velocity modification by way of the pinion gear and the ring gear.

As the pinion gear rotates at the modified velocity, the rotational movement is transferred to a constant velocity coupler. The coupler, in turn, rotates at the modified rotational velocity, eradicating any irregularities in the speed of rotation which occur as a consequence of the disparate positioning of the rotational axis of the pinion gear relative to the rotational axis of the barrel cam. The coupler imparts to the barrel cam a rotational movement having a modified velocity free from any variations. As the barrel cam rotates, the cam follower tracks the helical groove which traverses the outer diameter of the cam surface, thereby translating the rotational force imparted to the barrel cam into a smooth oscillating movement which is subsequently imparted to the roller casing by way of the internal support.

The oscillating roller assembly of the present invention affords several advantages over oscillating rollers of the prior art. As previously mentioned, it has been found that the even distribution of ink and other fluid coatings upon a receiving surface is facilitated by rollers having an oscillation capability and that special oscillating rollers having an internally contained oscillation means afford certain additional spatial advantages. Furthermore, with respect to these special oscillating rollers, it has been determined that the distribution of printing fluids or coatings by such rollers can be further enhanced where the velocity of oscillation is not solely a function of the rotational velocity of the roller, but is rather a function of the rotational velocity of the roller in conjunction with a means for accurately and independently reducing and maintaining a constant velocity for that portion of the rotational force which is subsequently translated into an oscillating movement.

A typical shortcoming of the prior art oscillating rollers having an internally disposed oscillation means is that either the oscillation velocity is essentially only a function of the rotational velocity of the roller or it is partially dependent upon a frictional component which is very difficult to establish and control. An additional shortcoming of these prior art rollers is that the oscillating motion becomes irregular at the edges of the oscillation cycle as the roller terminates its axial movement in one direction and proceeds to oscillate back in the opposite direction.

The oscillating roller of the present invention overcomes these problems. It contains an internally disposed oscillation means which accurately modifies the velocity of the portion of the rotational movement which is to be translated into an oscillating movement by way of a gear means having a ratio that can be accurately calculated and manipulated rather than by way of a frictional component that is difficult to predict and control.

Additionally, the oscillating roller of the present invention ensures the delivery of a smooth, oscillating motion to the roller assembly, even at the edges of the oscillation cycle, by providing a velocity-regulating means, such as a constant velocity coupler, to eradicate any irregularities in the velocity of that portion of the rotational force which is to be subsequently translated into an oscillating movement.

For a better understanding of the present invention, together with other and further objects, reference is made to the following description, taken together with the accompanying drawings, and its scope will be pointed out in the appended claims.

DETAILED DESCRIPTION OF THE INVENTION

Figure 1:
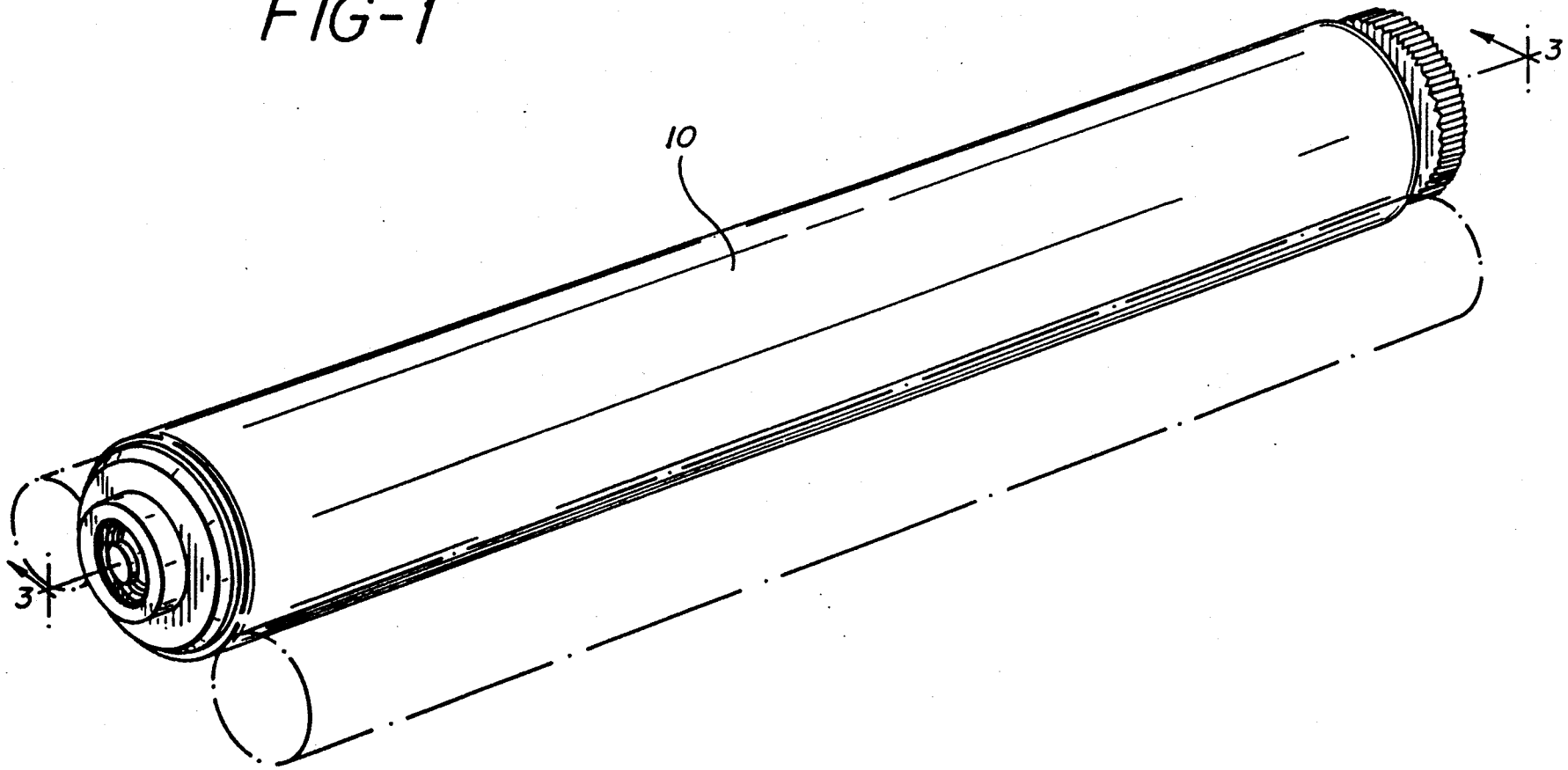
FIG. 1 is a perspective view of the oscillating roller assembly.
Figure 3:
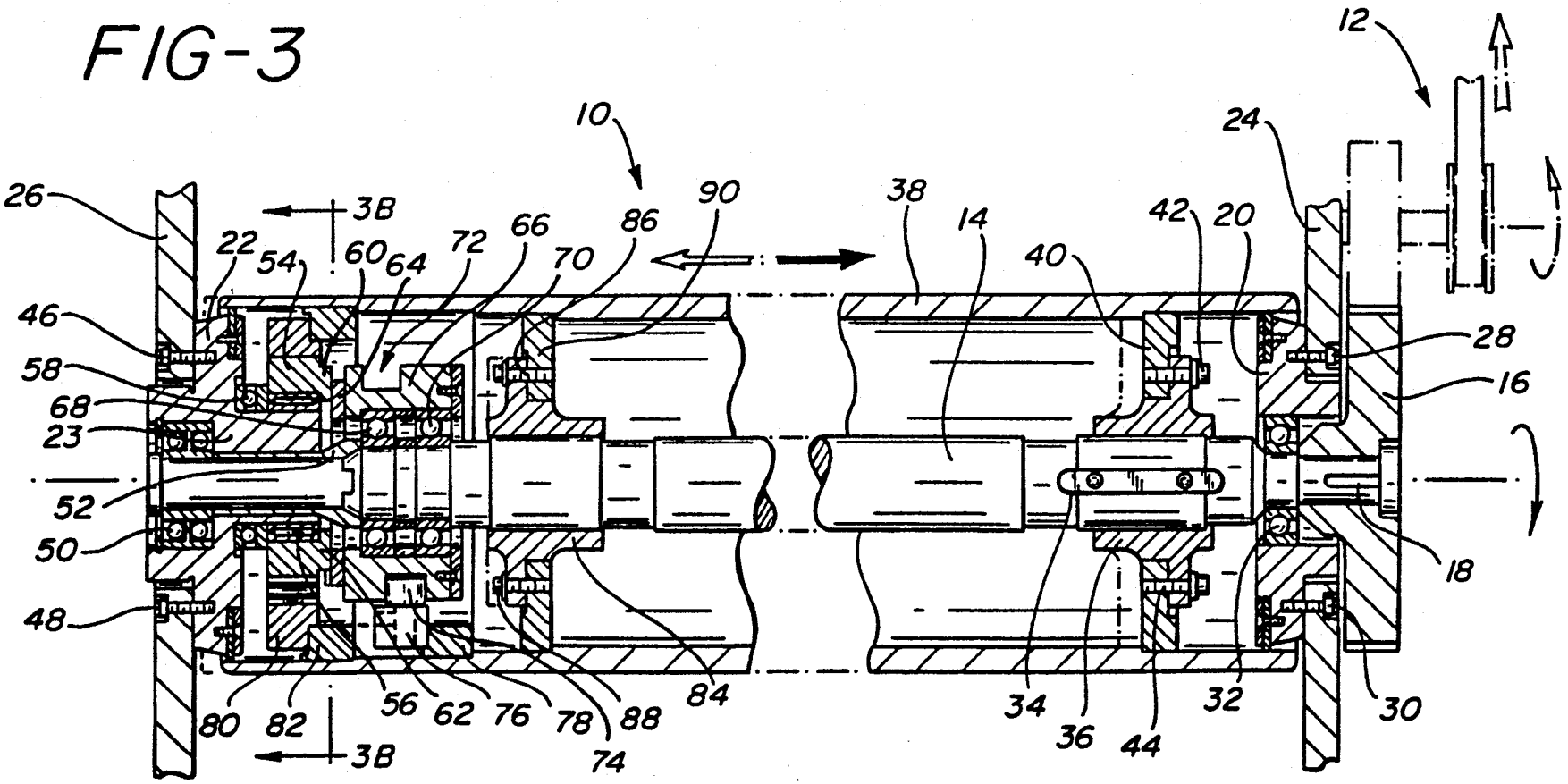
FIG. 3 is a cross sectional view of the oscillating roller assembly taken along lines 3—3 of FIG. 1.

Referring to FIG. 1, the oscillating roller 10 of the present invention is shown in a perspective view flanked by two additional rollers appearing in ghost lines. Referring to FIG. 3, the oscillating roller 10 of FIG. 1 is shown in cross section along lines 3—3. The roller 10 has a first and a second end. At the first end of the roller, an external drive means 12 is shown in communication with central shaft 14 by way of spur gear 16 mounted concentrically about shaft 14. A first key 18 affixed to shaft 14 fits into a keyway (not shown) on the inside diameter of spur gear 16 such that any rotational movement imparted to spur gear 16 by external drive means 12 is also imparted to shaft 14. In the preferred embodiment of the present invention, spur gear 16 is a 64T gear.

Bearing supports 20 and 22 are positioned at opposite ends of the shaft and function to hold the shaft in place within frame panels 24 and 26. Bearing support 20 is concentrically positioned about shaft 14 and is affixed to frame panel 24 by socket screws 28 and 30. The shaft 14 is freely rotatable within bearing support 20 by way of a single row ball bearing assembly 32. Affixed to shaft 14 is a second key 34 which communicates with a channel or keyway (not shown) on the internal diameter of slide hub 36.

Slide hub 36 is concentrically mounted about shaft 14. While the slide hub is free to slide axially about shaft 14, it must rotate by necessity with the shaft due to the presence of the keys affixed to the shaft. Slide hub 36 is also affixed to roller casing 38 by way of internal support 40. Socket screws 42 and 44 secure the slide hub 36 to the support 40 which is in turn affixed to the internal aspect of roller casing 38.

At the second end of roller assembly 10, bearing support 22 is concentrically positioned about shaft 14 and affixed to frame panel 26 by socket screws 46 and 48. The shaft is rotatably received within bearing support 22. Bearing support 22 includes an elevated shoulder portion 23 which is eccentrically oriented with respect to shaft 14. A double row ball bearing assembly 50 is interposed between the shaft and a portion of bearing support 22 to aid the rotation of the shaft. Similarly, spacer 52 is positioned between bearing support 22 and shaft 14 to provide for a smooth rotation of the shaft within the support and to retain bearing assemblies 68 and 70.

Mounted rotatably about the eccentrically positioned shoulder portion 23 of bearing support 22, is pinion gear 54, supported by needle roller bearing 56. Thrust bearing 58 is mounted about support bearing 22 and functions to maintain the axial positioning of the pinion gear and the roller bearing.

One side of pinion gear 54 has two raised tab-like projections 60 and 62 called dogs which are positioned 180° from one another on opposite edges of pinion gear 54. Referring to FIG. 2A, velocity coupler 64 has two recesses 65 and 67 formed therein to receive dogs 60 and 62, respectively. Dogs 60 and 62 function to impart rotational movement from pinion gear 54 to velocity coupler 64 by way of recesses 65 and 67. Velocity coupler 64 also has two dogs 69 and 71 positioned 180° from one another on opposite edges of velocity coupler 64 at right angles to recesses 65 and 67. Barrel cam 66 includes recesses 73 and 75 formed therein to receive dogs 69 and 71, respectively. Dogs 69 and 71 function to impart rotational movement from velocity coupler 64 to barrel cam 66 by way of recesses 73 and 75.

Referring again to FIG. 3, velocity coupler 64 is mounted about shaft 14, axially adjacent to pinion gear 54 on one side and barrel cam 66 on the other side. Barrel cam 66 is concentrically mounted about central shaft 14 and supported by dual ball bearing assemblies 68 and 70 which allow barrel cam 66 to rotate about shaft 14. A helical groove 72 is formed in the outer surface of barrel cam 66. Cam follower 74 is affixed to roller casing 38 via mounting block 76 and internal support 78 and is positioned within groove 72. As barrel cam 66 rotates, cam follower 74 rides in groove 72, translating the rotational movement of barrel cam 66 into an oscillating movement which is in turn imparted to roller casing 38 via mounting block 76 and internal support 78.

Figure 3A:
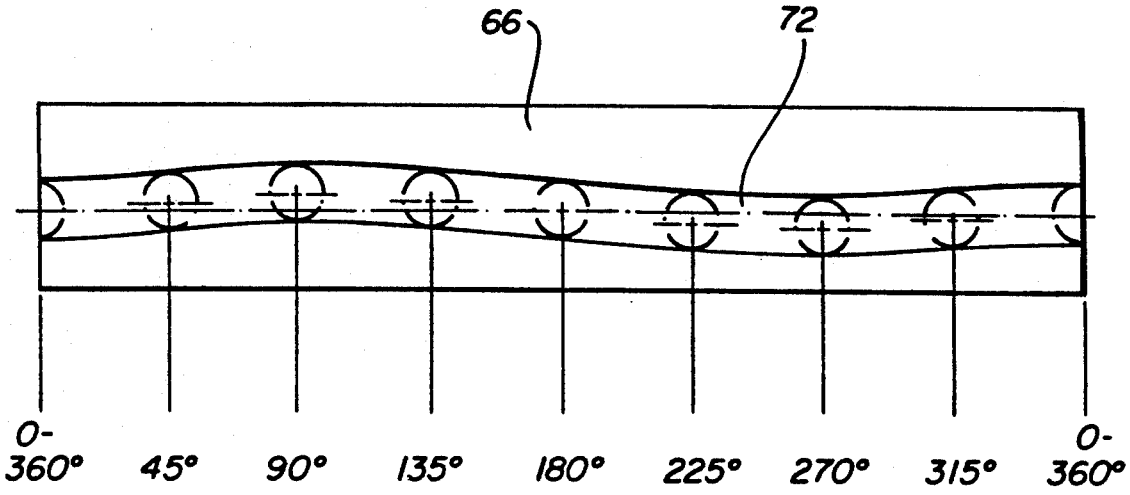
FIG. 3A is a schematic illustrating the outer diameter surface of barrel cam 66.

Referring to FIG. 3A, a schematic of the outer diameter surface of barrel cam 66 is shown, illustrating the pattern of helical groove 72 as it traverses the outer surface of the cam over a 360° rotation. The distance which the groove travels across the cam surface in an axial direction will determine the degree of oscillation imparted to the roller. For example, the degree of oscillation imparted to the preferred embodiment of the roller assembly illustrated herein is three-eighths of an inch for every 6 revolutions of the roller casing.

Referring again to FIG. 3, ring gear 80 is statically mounted to internal support 82 which in turn is affixed to the internal aspect of roller casing 38. Ring gear 80 has a series of gear teeth formed on its internal diameter and contains a large center bore in which the main body of pinion gear 54 is positioned.

Figure 3B:
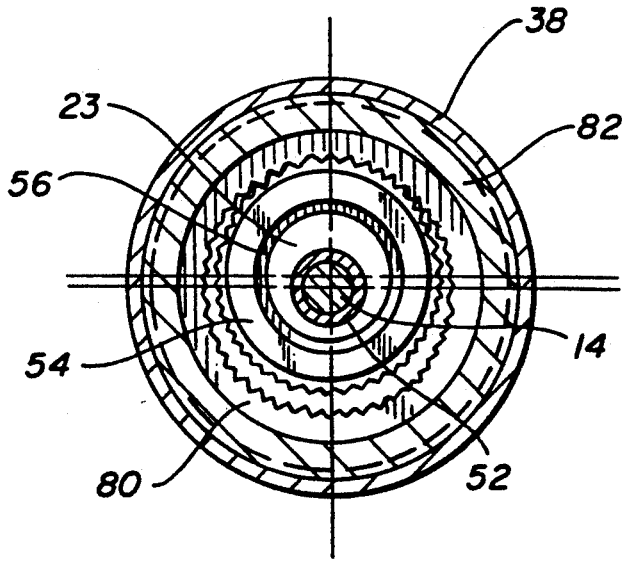
FIG. 3B is a cross-sectional view of the pinion gear/ring gear assembly taken along lines 3B—3B of FIG. 3.

Referring to FIG. 3B, pinion gear 54 is shown in cross-section, mounted within ring gear 80 as seen from lines 3B—3B of FIG. 3. Shoulder portion 23 of bearing support 22 is shown eccentrically positioned about shaft 14. Shoulder portion 23 is separated from the shaft by spacer 52. Mounted about shoulder portion 23 is roller bearing 56 which in turn provides support for pinion gear 54. Pinion gear 54 is eccentrically positioned about shaft 14 within the center bore of ring gear 80, such that the gear teeth on the external diameter of the pinion gear are in partial communication with the gear teeth on the internal diameter of the ring gear. The ring gear is affixed to the roller casing 38 by way of internal support 82. Consequentially, any rotational movement imparted to the roller casing is also imparted to the ring gear.

As the ring gear undergoes rotation, the gear teeth disposed on its internal diameter communicate with the gear teeth on the external diameter of the pinion gear, thereby imparting a rotational movement to the pinion gear at a velocity which is a function of both the rotational velocity of the roller casing as well as the gear ratio of the ring gear to the pinion gear. In the preferred embodiment of the present invention, the gear ratio should be such that one complete oscillation cycle is achieved per every 6 complete revolutions of the roller casing.

Referring once again to FIG. 3, slide hub 84 is concentrically mounted about shaft 14 and is affixed to internal support 90 by way of socket screws 86 and 88. Internal support 90 is affixed to the internal aspect of roller casing 38 such that any rotational movement imparted to the roller casing by way of slide hub 36 and internal support 40 is subsequentially transferred to slide hub 84 which rotates freely about shaft 14. In addition, slide hub 84 is free to move axially about the shaft in a manner similar to that of slide hub 36, as described earlier in the detailed description.

Referring still to FIG. 3, the oscillating roller of the present invention functions as follows. External drive means 12 delivers a rotational force to shaft 14 via spur gear 16. As shaft 14 rotates, a rotational movement is imparted to roller casing 38 by way of slide hub 36 and internal support 40. As roller casing 38 rotates, internal support 82 also rotates imparting a rotational movement to ring gear 80. As ring gear 80 undergoes rotation, the gear teeth present on the internal diameter of the gear communicate with the gear teeth of pinion gear 54, thereby imparting a rotational movement to the pinion gear.

It should be noted that the rotational velocity is modified at this point, the modification being a function of the gear ratio between the ring gear and the pinion gear. Since gear ratios can be precisely calculated and manipulated by methods known in the art, the gear system of the present invention affords a reliable means for modifying the velocity of the rotational movement imparted to barrel cam 66.

As the pinion gear 54 rotates, rotational movement occurring at the modified velocity is imparted to the constant velocity coupler 64 which functions to regulate the velocity, smoothing out any irregularities in the speed of rotation.

Velocity couplers are known in the mechanical arts, however, the velocity coupler of the present invention is preferably of the Oldham type and should be suitable for eradicating any irregularities in the speed of rotation occurring as a consequence of the disparate positioning of the rotational axis of the pinion gear relative to the rotational axis of the barrel cam.

Velocity coupler 64 in turn imparts a rotational movement to barrel cam 66, thereby causing the cam to rotate about the central shaft 14 via bearing assemblies 68 and 70. It is important to note that barrel cam 66 is not statically connected to the shaft 14 and does not rotate at the same speed as does the roller casing 38 or shaft 14, but rather rotates at the modified rotational velocity. As the barrel cam rotates, cam follower 74, positioned in helical groove 72, traverses the outer surface diameter of the cam, translating the rotational movement of the cam into an oscillating movement. This oscillating movement is subsequently transferred to the roller casing 38 by way of mounting block 76 and internal support 78.

Figure 2:
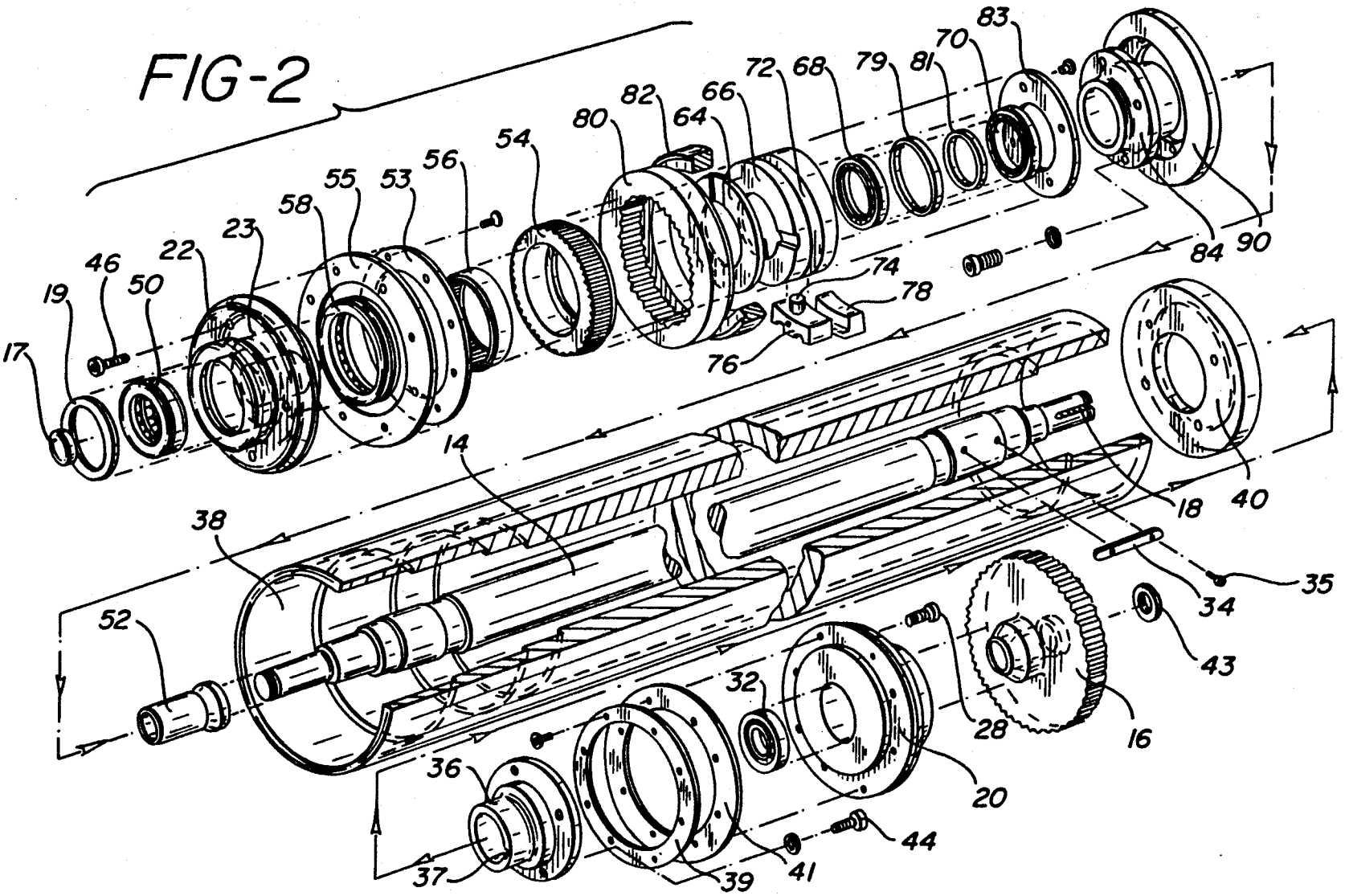
FIG. 2 is an exploded, perspective view of the oscillating roller assembly of FIG. 1.
Figure 2A:
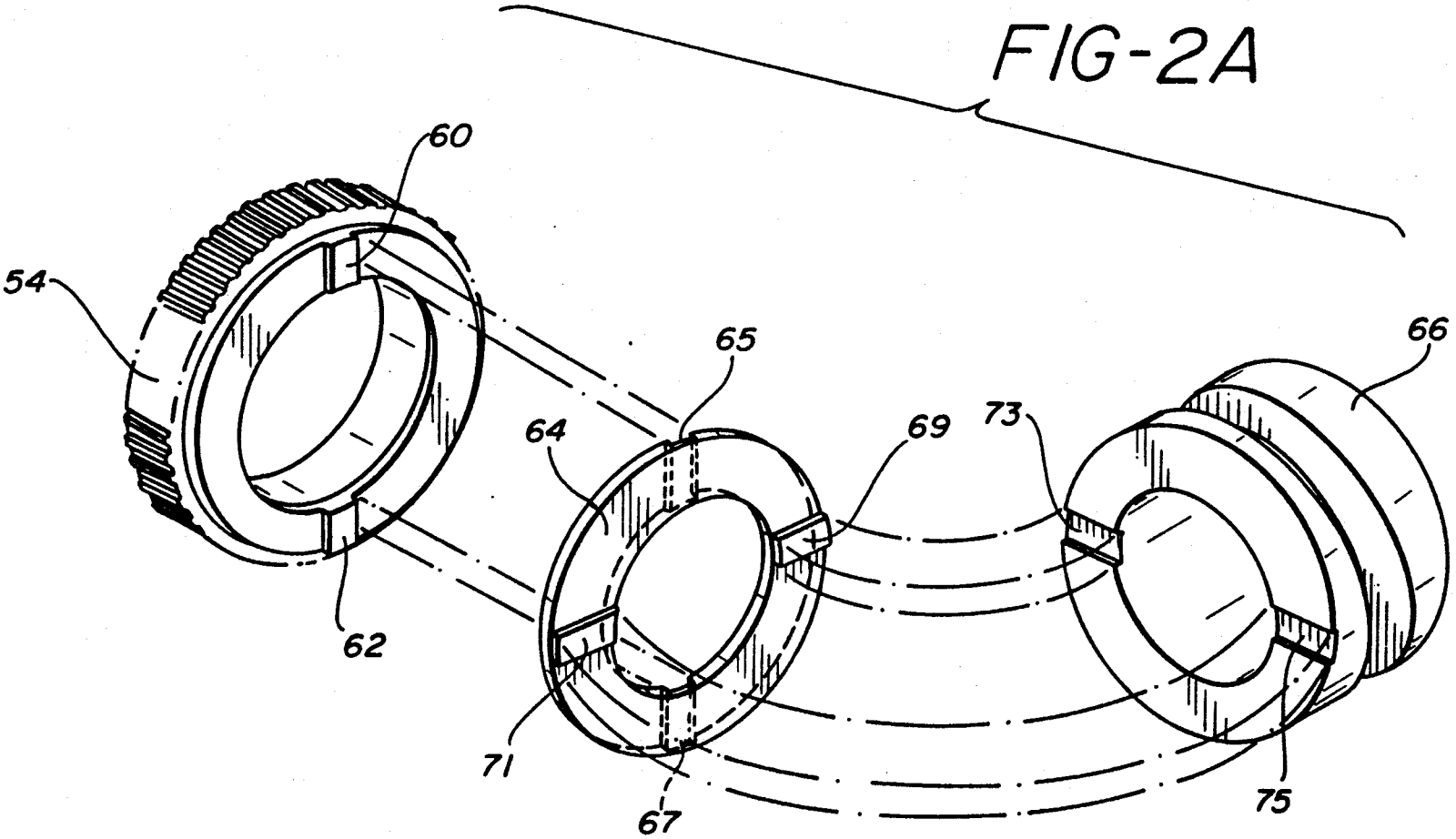
FIG. 2A is an enlarged, exploded view of the velocity coupler component of FIG. 2 shown schematically in communication with the barrel cam and pinion gear components of FIG. 2.

Referring now to FIG. 2, the oscillating roller assembly 10 of FIG. 1 is shown in an exploded, perspective view. Central shaft 14 is positioned within roller casing 38. Key 18 is positioned at one end of shaft 14 while key 34 is affixed to the surface of shaft 14 by some fastening means, an example of which is illustrated by screw 35. Internal support 40 is positioned about shaft 14 and affixed to the internal aspect of roller casing 38. Slide hub 36 is positioned about shaft 14 adjacent to support 40 in such a fashion as to afford communication between key 34 and keyway 37 positioned on the internal aspect of slide hub 36. Socket screw 42 (not shown) and socket screw 44 are examples of a suitable means for securing slide hub 36 to internal support 40. Seal 39 and seal ring 41 are positioned about shaft 14 adjacent to bearing support 20 which houses single row ball bearing assembly 32. Socket screw 28 and socket screw 30 (not shown) are examples of a suitable means for securing bearing support 20 to frame panel 24 (see FIG. 3). Spur gear 16 is mounted about shaft 14 in such a fashion as to communicate with key 18, thereby providing a drive means for shaft 14. End cap 43 is positioned at the end of shaft 14 adjacent to spur gear 16.

At the opposite end of shaft 14, internal support 90 is mounted about the shaft, followed by slide hub 84. Socket screw 88 and socket screw 86 (not shown) are examples of a suitable means for securing slide hub 84 to internal support 90. Bearing retainer plate 83, ball bearing assembly 70, spacer 81, spacer 79, and ball bearing assembly 68 are subsequently positioned about shaft 14 followed by barrel cam 66. Spacer 52 is positioned about shaft 14 to retain bearing assemblies 68 and 70. Cam follower 74 is affixed to mounting block 76 which is in turn affixed to internal support 78 which is in turn affixed to roller casing 38. The cam follower is positioned within the roller casing so as to reside in helical groove 72 which traverses the outer surface diameter of barrel cam 66. Velocity coupler 64 is positioned about shaft 14 and mated to barrel cam 66 so as to impart rotational movement to the cam.

Internal support 82, shown in broken sectional view, is positioned about shaft 14 along with ring gear 80 to which it is affixed. Pinion gear 54 is eccentrically positioned within the center bore of ring gear 80 in such a fashion so as to communicate with velocity coupler 64 as well as providing for a partial communication of the gear teeth formed on its external diameter with the gear teeth formed on the internal diameter of the ring gear. Roller bearing 56 is positioned within the internal aspect of pinion gear 54 so as to create a sleeve through which shoulder portion 23 of bearing support 22 can be received. Seal 53 and seal ring 55 are positioned about bearing support 22 which is in turn positioned about shaft 14 so as to provide support for pinion gear 54 as well as shaft 14. Socket screw 46 and socket screw 48 (not shown) are examples of a suitable means for securing bearing support 22 to frame panel 26 (see FIG. 3). Double row ball bearing assembly 50 is positioned within bearing support 22 to provide for the smooth rotation of shaft 14 within the support. Retaining ring 19 and end cap 17 are positioned at the end of shaft 14 opposite end cap 43.

Although the oscillating roller assembly of the present invention can be employed in a variety of industrial situations where a roller having an inboard oscillating means is required, the present roller assembly is preferably employed in a coating mechanism which applies a liquid coating to a printed web in a printing press unit. Where the coating mechanism is employed in a printing press unit, the oscillating roller typically performs a metering function as well as an oscillating function. The present roller assembly is especially ideal where a coating mechanism must be fitted to an existing printing press unit, since spatial considerations are frequently more problematic. Although the present roller assembly may be adapted for use in a variety of coating machines, it is preferably employed in the following manner.

Figure 4:
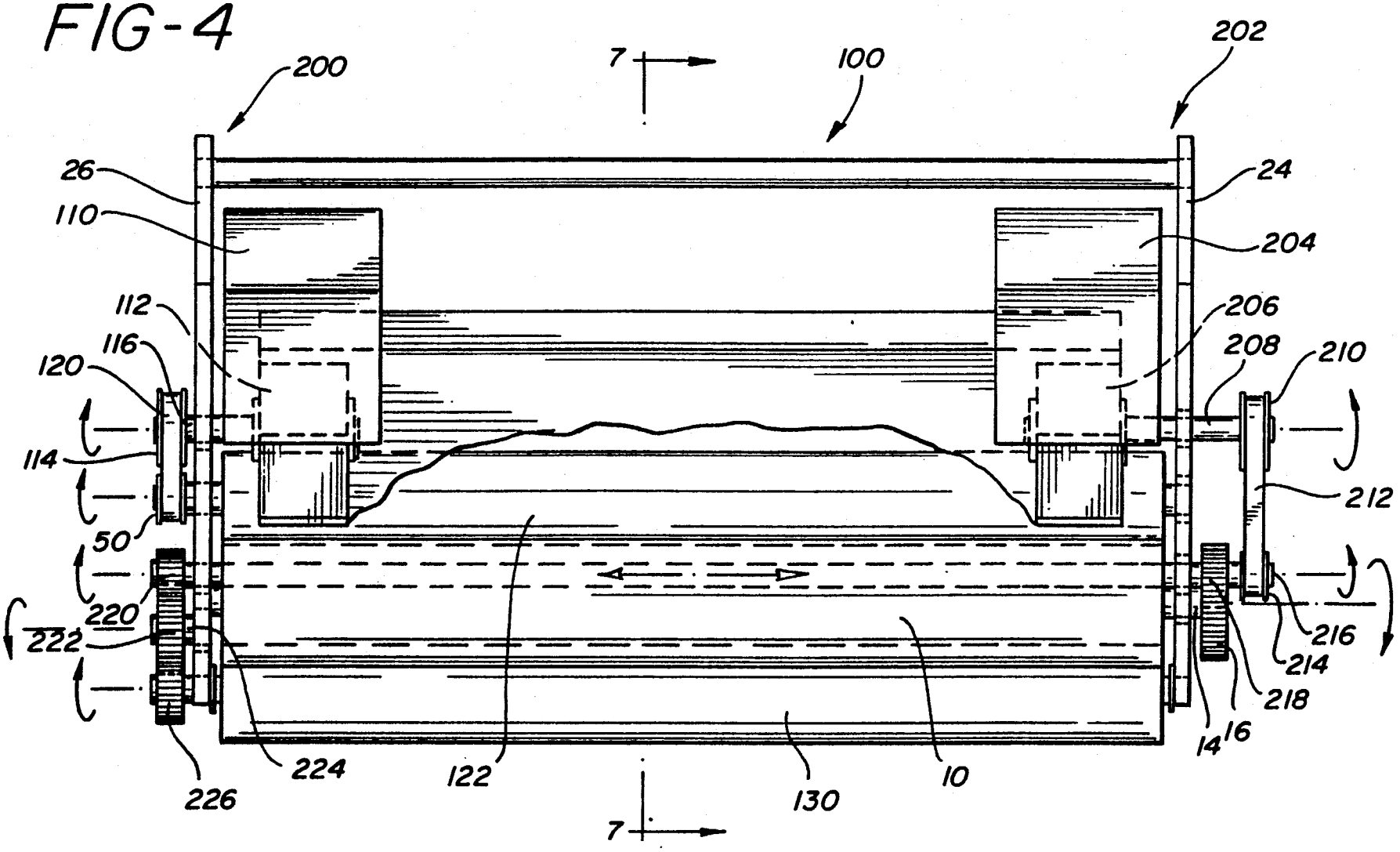
FIG. 4 is a top plan view schematically illustrating the preferred embodiment of the coating mechanism containing the oscillating roller assembly of the present invention.

Referring now to FIG. 4, the preferred embodiment of the coating mechanism employing the oscillating roller of the present invention is shown schematically in top plan view. Motor 110 is positioned at workside 200 of coating mechanism 100 to drive gear reducing unit 112. Gear reducing unit 112 functions to reduce the speed of the rotational force delivered to pulley 114 mounted on shaft 116. Shaft 116 exits gear reducing unit 112 passing through frame panel 26 to support and drive pulley 114. Timing belt 120 transfers the rotational drive force from pulley 114 to pulley 150 mounted at the end of pan roller 122. Motor 204 is positioned at gearside 202 of coating mechanism 100 and drives gear reducing unit 206. Shaft 208 exits gear reducing unit 206 passing through frame panel 24 to support and drive pulley 210. Timing belt 212 transfers the rotational drive force from pulley 210 to crossover shaft 216 by way of pulley 214. Drive gear 218 is mounted on crossover shaft 216 and transfers the rotational force from the crossover shaft to spur gear 16 mounted on shaft 14 of oscillating roller 10. In the preferred embodiment of the present invention, drive gear 218 is a 36T gear.

Mounted on crossover shaft 216 at workside 200 of coating mechanism 100 is drive gear 220 which drives idler gear 222. Idler gear 222 is rotatably mounted about shaft 224 which is, in turn, received in frame panel 26. The idler gear communicates with drive gear 226 which, in turn, rotates applicator roller 130. In the preferred embodiment of the present invention, drive gear 220 is a 30T gear while idler gear 222 is a 50T gear and drive gear 226 is a 40T gear.

Figure 7:
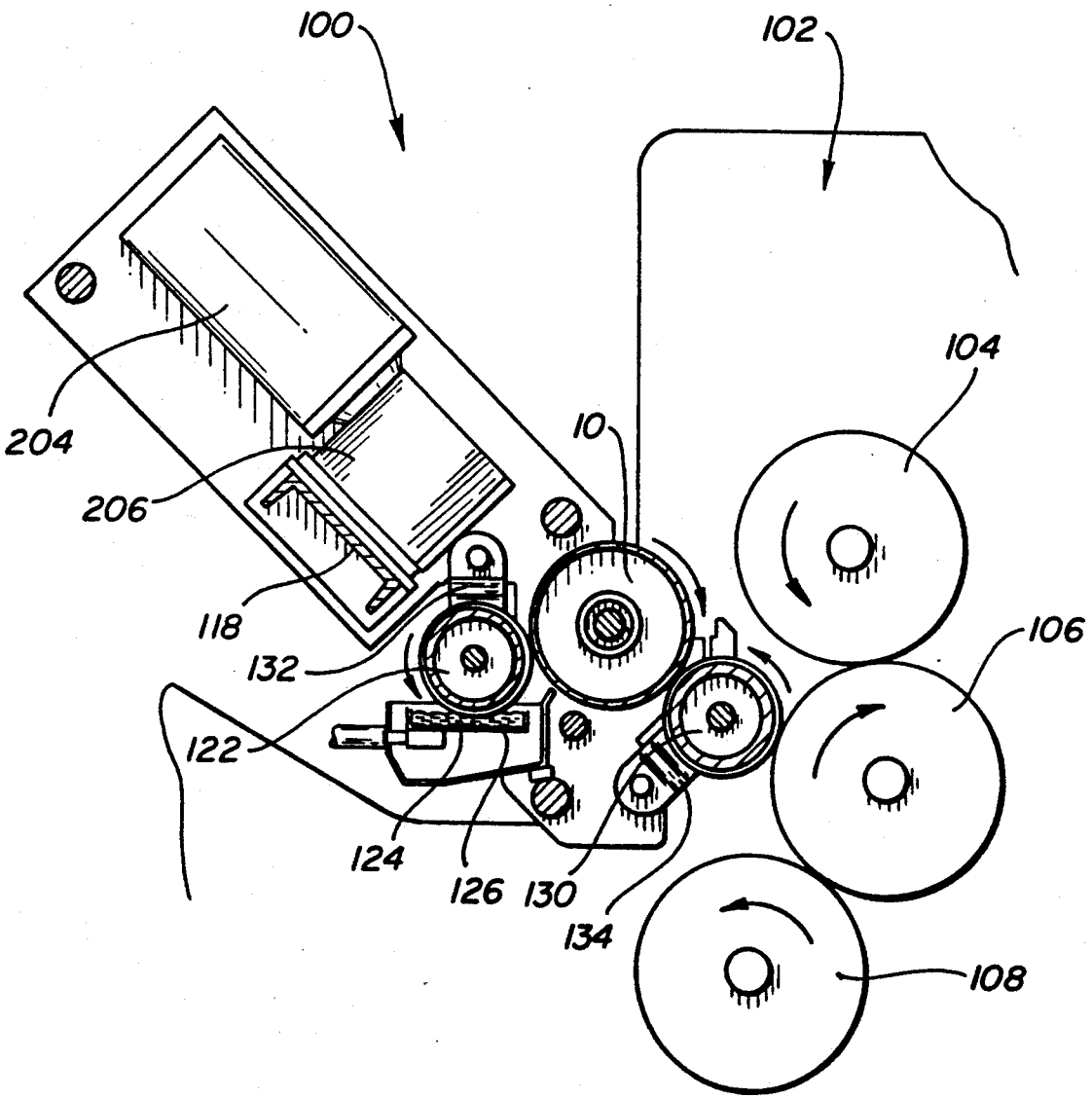
FIG. 7 is a partial cross-sectional view of the roller configuration of the coating mechanism of FIG. 4 taken along lines 7—7 and shown schematically contacting the blanket roller of a press unit.

FIG. 7 is a partial cross-sectional view of the preferred embodiment of the roller configuration for the coating mechanism of the present invention as taken across lines 7—7 of FIG. 4. The coating mechanism 100 is shown schematically contacting blanket roller 106 of press unit 102. Motor 204 is contained within the coating mechanism 100 and communicates with gear reducing unit 206. Channel support 118 functions to provide support for gear reducing unit 206.

Motor 204 drives gear reducing unit 206 which, in turn, drives pan roller 122. Pan roller 122 rotates contacting coating fluid 124 present in tray 126 and transfers it to oscillating roller 10. Oscillating roller 10 in turn transfers the coating fluid 124 to applicator roller 130, simultaneously undergoing a rotational and oscillating movement. Due to the presence of the novel oscillating mechanism contained within it, the oscillating roller is able to smoothly oscillate axially back and forth at a velocity which is accurately differentiated from its rotational velocity. These operational features allow the oscillating roller to deliver a uniform, evenly distributed coating layer to the applicator roller. The applicator roller 130 then transfers the uniform fluid layer to blanket cylinder 106 which is positioned between plate cylinder 104 and impression cylinder 108. Blanket cylinder 106 subsequently delivers the uniform fluid layer to a web received between impression cylinder 108 and blanket cylinder 106.

Pan roller 122 is supported by adjustable support arm 132 which adjusts the position of the pan roller toward or away from oscillating roller 10. Similarly, applicator roller 130 is supported by adjustable support arm 134 which adjusts the position of the applicator roller toward or away from oscillating roller 10. By adjusting support arm 132, the degree and strength of contact between pan roller 122 and oscillating roller 10 can be manipulated. Similar manipulations can be accomplished as between applicator roller 130 and oscillating roller 10. Consequently, the oscillating roller performs a metering function by virtue of its positioning between the pan roller and the applicator roller.

Figure 5:
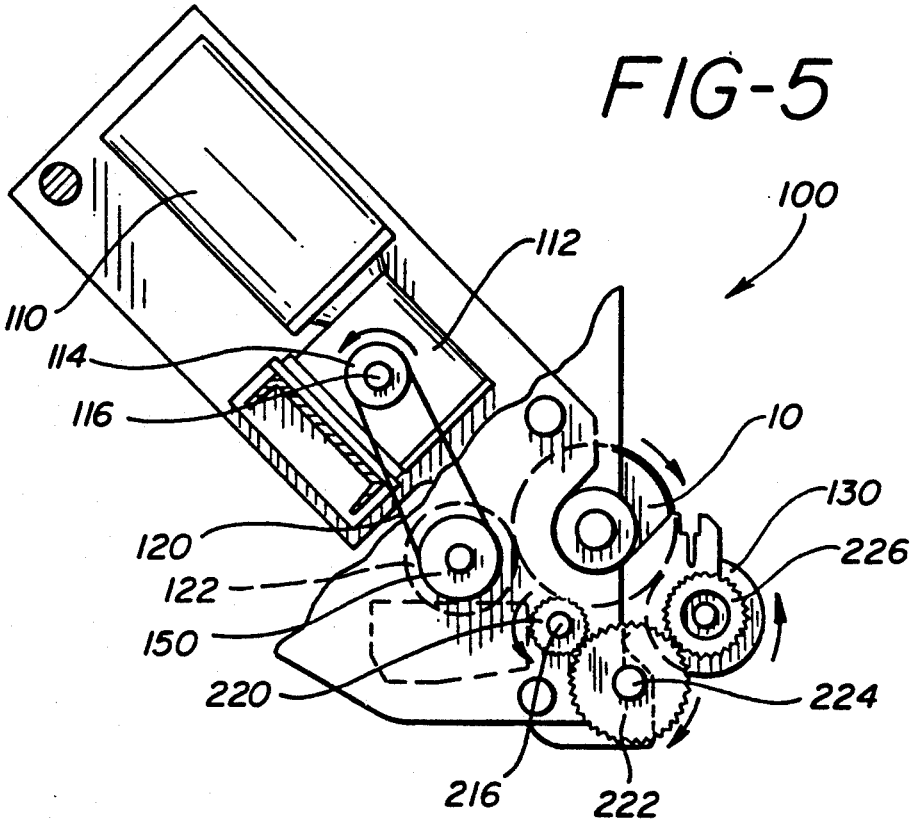
FIG. 5 is a partial left side elevational view of the work side drive of the coating mechanism of FIG. 4.

Referring to FIG. 5, coating mechanism 100 of FIG. 4 is shown in partial left side elevational view to further illustrate the workside drive configuration of the mechanism. Motor 110 communicates with end drives gear reducing unit 112. Shaft 116 exits gear reducing unit 112 driving pulley 114. Timing belt 120 transfers the drive force from pulley 114 to pulley 150 affixed to pan roller 122, thereby imparting rotation to the roller. Pan roller 122 is positioned adjacent to oscillating roller 10 which is, in turn, positioned adjacent applicator roller 130. Drive gear 220 is affixed to crossover shaft 216 driving idler gear 222 upon rotation of crossover shaft 216. Idler gear 222 is mounted on shaft 224 and communicates with drive gear 226 affixed to applicator roller 130, thereby imparting rotation to the roller.

Figure 6:
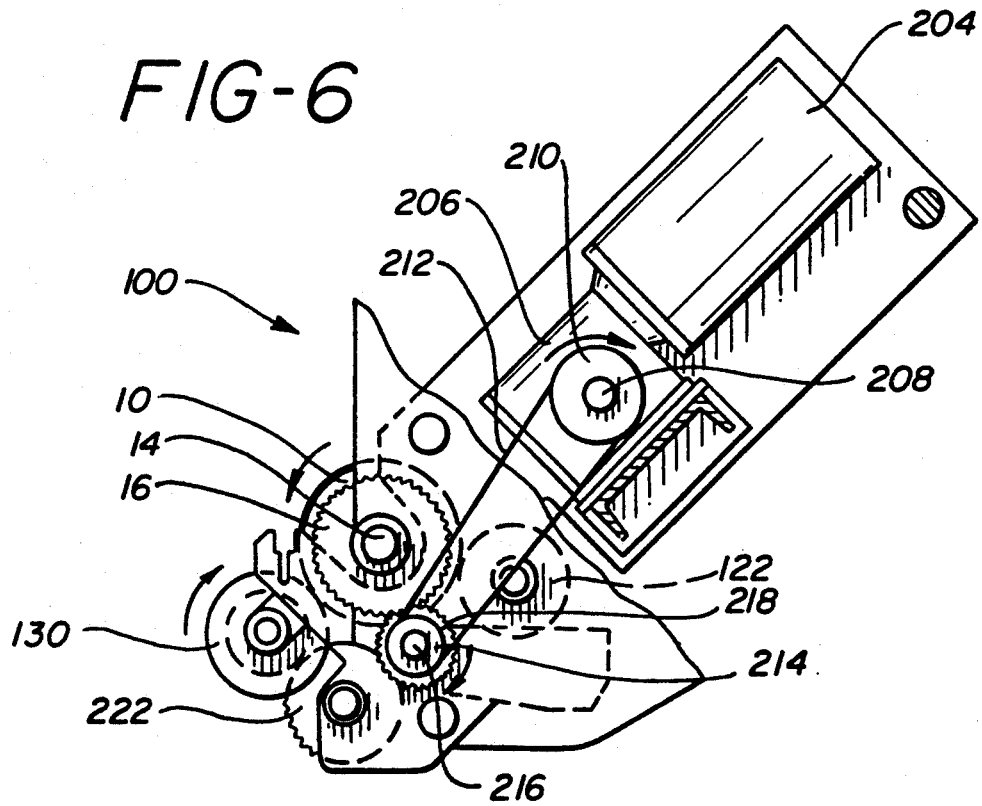
FIG. 6 is a partial right side elevational view of the gearside drive of the coating mechanism of FIG. 4.

Referring to FIG. 6, coating mechanism 100 of FIG. 4 is shown in partial right side elevational view to further illustrate the gearside drive configuration of the mechanism. Motor 204 communicates with and drives gear reducing unit 206. Shaft 208 exits gear reducing unit 206 driving pulley 210. Timing belt 212 transfers the drive force from pulley 210 to pulley 214 mounted on crossover shaft 216. Drive gear 218 is affixed to crossover shaft 216. As crossover shaft 216 rotates, drive gear 218 drives spur gear 16 which is mounted about shaft 14. As spur gear 16 rotates, it imparts rotation to oscillating roller 10. Also shown are pan roller 122 and applicator roller 130. Idler gear 222 is partially shown but actually resides at the workside.

While there have been described what are presently believed to be the preferred embodiments of the invention disclosed herein, those skilled in the art will realize that changes and modification may be made thereto without departing from the spirit of the invention, and it is intended to claim all such changes and modifications as fall within the true scope of the invention.

What is claimed is:

1. A liquid coating apparatus for a printing press comprising:

a frame;

at least one rotatable roller mounted for rotation within said frame;

drive means operatively coupled to said rotatable roller for driving said rotatable roller;

supply means operatively coupled to said rotatable roller for supplying a coating fluid thereto;

applicator means operatively coupled to said rotatable roller for applying said coating fluid to a printing press; and an oscillating roller having a rotatable shaft and an outer roller casing mounted about said shaft for rotation thereabout, said oscillating roller mounted for rotation within said frame and operatively coupled to said rotatable roller so as to meter the amount of coating fluid delivered to said printing press, said oscillating roller also having internally disposed oscillation means for imparting oscillation to said roller casing along its rotational axis, said oscillation means including velocity-modifying means for modifying the velocity of rotational motion and translating means for translating rotational motion into oscillation motion, said modifying means comprising at least a first and a second cooperating gear, said gears having a predetermined gear ratio, said first gear being operatively coupled to said roller casing so as to receive any rotational motion imparted to said casing and said second gear being operatively coupled to said first gear so as to receive any rotational motion imparted thereto, said gears operating to modify the velocity of any rotational motion imparted to said gears by way of said roller casing, said gears being operatively coupled to said translating means so as to impart rotational motion thereto, said translating means being capable of translating any rotational motion received thereby into an oscillating motion, said translating means being operatively coupled to said roller casing so as to impart oscillating motion thereto.

2. The liquid coating apparatus of claim 1, wherein a velocity regulating coupling is operatively coupled to said velocity-modifying means so as to receive rotational movement therefrom, said velocity-regulating means operating to regulate the velocity of the rotational movement imparted thereto, thereby eradicating any irregularities in velocity, said velocity-regulating means being operatively coupled to said translating means to impart rotational movement thereto.

3. The liquid coating apparatus of claim 1, wherein said applicator means comprises an applicator roller.

4. The liquid coating apparatus of claim 3, wherein said applicator roller contacts a blanket cylinder of said printing press unit to deliver said coating fluid to said press unit.

5. The liquid coating apparatus of claim 3, wherein a pan roller transfers said coating fluid from a coating fluid reservoir to said oscillating roller.

6. The liquid coating apparatus of claim 3, wherein said oscillating roller transfers said coating layer to said applicator roller.

7. The liquid coating apparatus of claim 5, wherein said oscillating roller transfers said coating layer to said applicator roller.

8. The liquid coating apparatus of claim 7, wherein said oscillating roller performs a metering function as well as an oscillating function.

9. The liquid coating apparatus of claim 7, wherein said pan roller and said applicator roller supported by a first and a second adjustable support arm, respectively.

10. The liquid coating apparatus of claim 7, wherein said drive means comprises a first and a second drive unit, said first drive unit driving said pan roller and said second drive unit driving said applicator roller and said oscillating roller.

11. The liquid coating apparatus of claim 2, further comprising a pan roller to transfer said coating fluid from a coating fluid reservoir to said oscillating roller and wherein said oscillating roller transfers said coating fluid to said applicator means.

12. An oscillation mechanism for a roller, said mechanism internally disposed within said roller and comprising:

velocity-modifying means operatively coupled to said roller for receiving rotational movement imparted to said roller, said velocity-modifying means comprising at least a first and a second cooperating gear, said first gear being operatively coupled to said roller and said second gear being operatively coupled to said first gear so as to receive any rotational motion imparted thereto, said gears operating to modify the velocity of any rotational motion imparted to said gears by way of said roller; and translating means for translating rotational movement into oscillating movement, said translating means being operatively coupled to said velocity-modifying means so as to receive rotational movement therefrom, said translating means being capable of translating rotational movement into oscillating movement, said translating means being operatively coupled to said roller so as to impart oscillating movement to said roller.

13. The oscillation mechanism of claim 12, wherein a velocity-regulating coupling is operatively coupled to said velocity-modifying means so as to receive rotational movement therefrom, said velocity-regulating means operating to regulate the velocity of the rotational movement imparted thereto, thereby eradicating any irregularities in velocity, said velocity-regulating means being operatively coupled to said translating means to impart rotational movement thereto.

14. The oscillation mechanism of claim 12, wherein said translating means comprises a cam and a cam follower.

15. The oscillation mechanism of claim 12, wherein said first and second gears communicate with one another and having a specified gear ratio.

16. The oscillation mechanism of claim 13, wherein said velocity-regulating means comprises a constant velocity coupler.

17. An oscillating roller assembly having an internally disposed oscillation mechanism comprising:

a roller casing having an internal and an external surface;

a central shaft about which said roller casing is slidably mounted to allow movement of said roller casing in an axial direction about said shaft from a first position to a second position, said movement defining a period of oscillation for said roller assembly;

a means for operatively coupling said casing to said shaft so as to impart a rotational movement of said shaft to said roller casing to produce a rotational movement of said casing;

velocity-modifying means comprising at least a first and a second cooperating gear, first gear being operatively coupled to said roller casing so as to receive any rotational motion imparted to said casing and said second gear being operatively coupled to said first gear so as to receive any rotational motion imparted thereto, said gears operating to modify the velocity of any rotational motion imparted to said gears by way of said roller casing, said gears being operatively coupled to said translating means so as to impart rotational motion thereto, said translating means being capable of translating any rotational motion received thereby into an oscillating motion, said translating means being operatively coupled to said roller casing so as to impart oscillating motion thereto.

18. The oscillating roller assembly of claim 17, wherein said translating means comprises a cam and a cam follower.

19. The oscillating roller assembly of claim 17, wherein said gears have a specified gear ratio.

20. The oscillating roller assembly of claim 19, wherein said first gear comprises a ring-shaped gear having an internal and an external circumferential surface, said internal circumferential surface created by a center bore formed axially therethrough said first gear and having a series of gear teeth formed therein, said first gear being affixed to said internal surface of said roller casing such that said rotational movement of said casing is imparted to said first gear, and wherein said second gear comprises a pinion-type gear having an exterior circumferential surface, said exterior surface having a series of gear teeth formed thereon, said second gear being eccentrically positioned about said central shaft and within said center bore of said first gear so as to provide partial communication of said gear teeth formed on said exterior circumferential surface of said second gear with said gear teeth formed on said internal circumferential surface of said first gear, said communication imparting a rotational force from said first gear to said second gear, thereby forcing said second gear to undergo rotational movement having a velocity component.

21. The oscillating roller assembly of claim 20, wherein said velocity-regulating means comprises a constant velocity coupler and said translating means comprises a cam and a cam follower.

22. The oscillating roller assembly of claim 21, wherein said cam is a barrel cam having an outer circumferential surface, said outer circumferential surface having a helical groove formed therein, said groove axially and circumferentially traversing said outer circumferential surface of said barrel cam wherein said cam follower is positioned, said cam follower being affixed to said internal surface of said roller casing, and wherein said barrel cam is rotatably mounted about said central shaft and positioned such that said barrel cam rotates about said shaft when acted upon by said constant velocity coupler, said cam follower tracking said groove to produce an oscillating movement, said oscillating movement being imparted to said roller casing by way of said cam follower.

23. The oscillating roller assembly of claim 22, wherein said roller casing is slidably mounted about said central shaft by way of a slide hub.

24. The oscillating roller assembly of claim 23, wherein said second gear is mounted about a bearing support positioned eccentrically about said central shaft, said shaft being rotatably received through said bearing support.

25. An oscillating roller assembly having an internally disposed oscillation mechanism comprising:

a central shaft having a first and a second end, said shaft rotatably received by a first bearing support mounted concentrically about said shaft at said first end and a second bearing support positioned concentrically about said shaft at said second end, said shaft being supported within said first bearing support by a first bearing assembly and within second bearing support by a second bearing assembly;

a drive means positioned at said first end of said shaft to receive a drive force externally delivered to said drive means and to transfer said drive force to said shaft, thereby rotating said shaft;

a roller casing having an internal and an external surface, said casing mounted concentrically about said shaft by way of a first and a second slide hub, said first and second slide hubs slidably mounted about said shaft to allow for movement of said first and second slide hubs about said shaft in an axial direction, said first slide hub being positioned closer to said first end of said shaft than said second slide hub and said first slide hub being affixed to said shaft such that a rotation of said shaft is imparted to said first slide hub, said first slide hub being also affixed to said roller casing so as to impart said rotation of said shaft to said roller casing, said rotation of said roller casing having a given velocity component;

a velocity-modifying means comprising a first and a second gear positioned at said second end of said shaft, said gears having a specified gear ratio, said first gear being ring-shaped and having an internal and an external circumferential surface, said internal circumferential surface created by a center bore formed axially therethrough said first gear and having a series of gear teeth formed therein, said first gear being affixed to said internal surface of said roller casing such that said rotation of said casing is imparted to said first gear, and wherein said second gear comprises a pinion-type gear having an exterior circumferential surface, said exterior surface having a series of gear teeth formed thereon, said second gear being eccentrically positioned about said second bearing support within said center bore of said first gear so as to provide partial communication of said gear teeth formed on said exterior circumferential surface of said second gear with said gear teeth formed on said internal circumferential surface of said first gear, said communication imparting a rotational force from said first gear to said second gear, thereby forcing said second gear to undergo a modified rotational movement having a modified velocity component;

a constant velocity coupler operatively coupled to said second gear so as to receive said modified rotational movement having said modified velocity component, and to regulate said modified velocity component eradicating any irregularities in velocity to produce a regulated, modified rotational movement having a regulated, consistent, modified velocity component; and a barrel cam rotatably mounted about said shaft and operatively coupled to said constant velocity coupler so as to receive said regulated, modified rotational movement, said barrel cam having an outer circumferential surface, said surface having a helical groove formed therein, said groove axially and circumferentially traversing said outer circumferential surface wherein a cam follower is positioned, said cam follower being affixed to said internal surface of said roller casing to track said groove upon rotation of said barrel cam thereby producing an oscillating movement, said oscillating movement being imparted to said roller casing by way of said cam follower.

* * * * *